United States Patent [19]

Greenberg

[11] Patent Number: 4,603,827

[45] Date of Patent: Aug. 5, 1986

[54] SHEET METAL MOUNTING DEVICE

[75] Inventor: Robert Greenberg, Los Angeles, Calif.

[73] Assignee: Bobrick Washroom Equipment, Inc., North Hollywood, Calif.

[21] Appl. No.: 368,522

[22] Filed: Apr. 15, 1982

[51] Int. Cl.[4] ..... F16M 13/00

[52] U.S. Cl. ..... 248/542; 248/27.1

[58] Field of Search ..... 248/27.1, 542, DIG. 6, 248/DIG. 1, 57, 27.3; 220/18; 312/228, 140.4; 70/451; 411/970, 112, 103

[56] References Cited

U.S. PATENT DOCUMENTS

| | | | |
|---|---|---|---|
| 2,214,388 | 9/1940 | Summers | 248/57 |
| 2,423,757 | 7/1947 | Dedge | 248/57 |
| 2,464,160 | 3/1949 | Stanitz | 312/228 |
| 2,670,919 | 3/1954 | Esoldi | 248/57 |
| 2,971,737 | 2/1961 | Parker | 248/DIG. 6 |
| 3,474,994 | 10/1969 | Swanquist | 248/DIG. 6 |
| 3,478,801 | 11/1969 | Van Niel | 411/970 |
| 3,491,974 | 1/1970 | Swanquist | 248/DIG. 6 |
| 3,517,903 | 7/1970 | Gutshall | 248/DIG. 6 |
| 3,606,223 | 9/1971 | Havener | 248/DIG. 6 |
| 3,680,152 | 8/1972 | Farrell | 312/228 |
| 3,780,209 | 12/1973 | Schuplin | 248/DIG. 6 |
| 3,887,802 | 6/1975 | Goralnik | 220/18 |
| 4,120,416 | 10/1978 | Suk | 248/DIG. 1 |
| 4,140,293 | 2/1979 | Hansen | 248/DIG. 6 |
| 4,267,993 | 5/1981 | Shimizu et al. | 248/27.1 |
| 4,403,708 | 9/1983 | Smolik | 248/DIG. 6 |

*Primary Examiner*—Ramon S. Britts
*Assistant Examiner*—Ramon O. Ramirez
*Attorney, Agent, or Firm*—Lyon & Lyon

[57] ABSTRACT

A sheet metal insert, such as a medicine cabinet, to be installed in a framed cavity is provided with tabs attached to the side of the insert and the tabs are of a sufficient length to be bent toward or away from the insert to be attached to the side of the cavity to accommodate variations in the size of the cavity. An opening in the side of the insert opposite the extending end of each tab provides access to a screw for securing the tab to the cavity.

11 Claims, 2 Drawing Figures

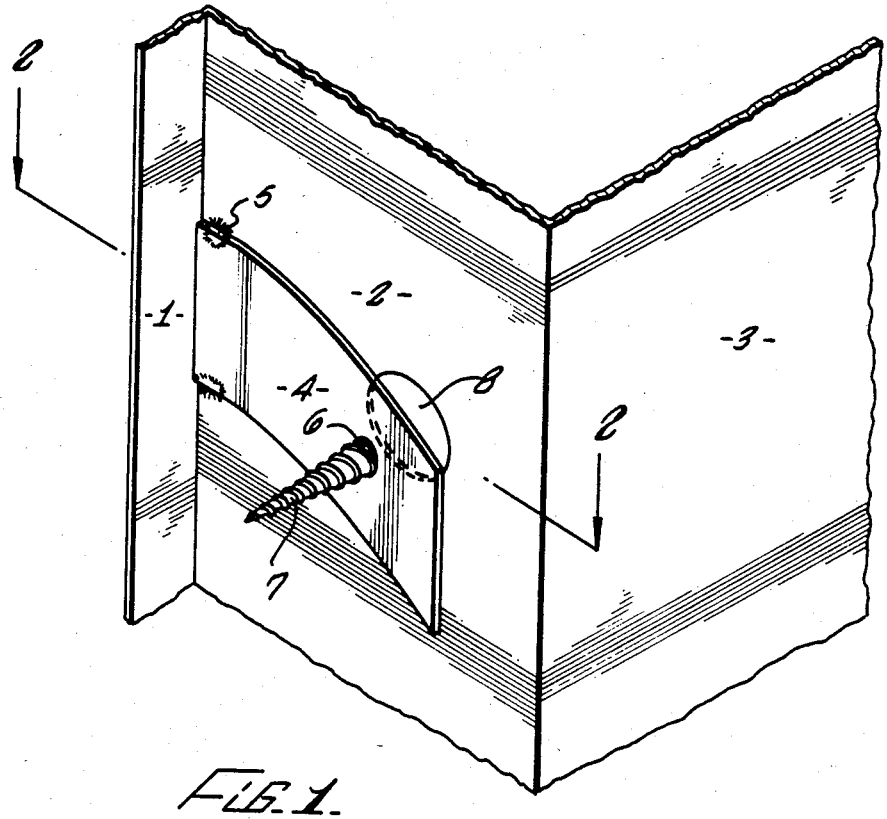
FIG. 1.
FIG. 2.
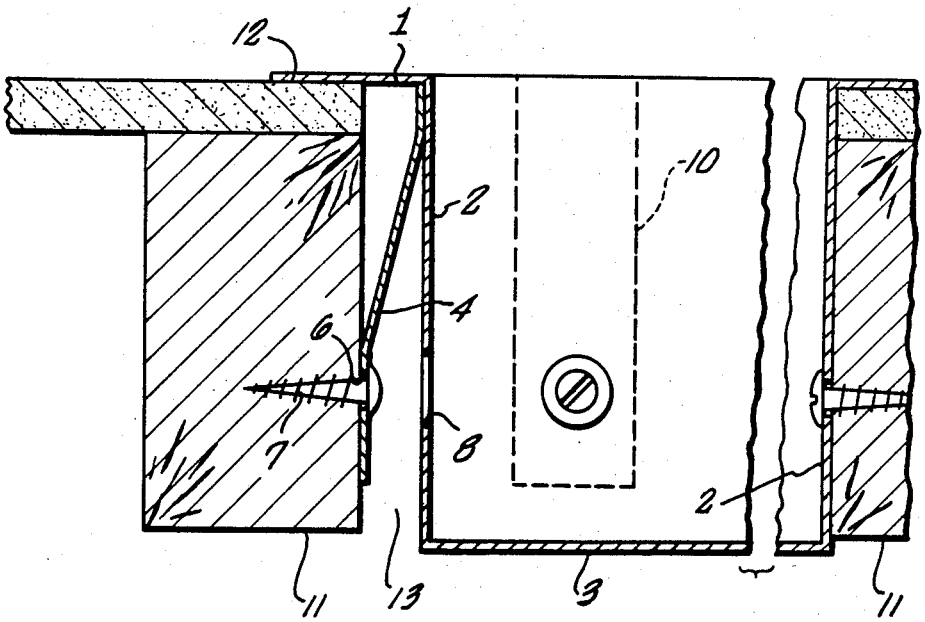

SHEET METAL MOUNTING DEVICE

The invention relates to the problem of inserting, into wall cavities, various structures constructed of sheet metal. Specifically, the invention concerns a device for mounting such structures when the cavity receiving the structure is not of exactly the same dimensions as the structure itself.

It is frequently desirable to mount certain functional sheet metal structures into wall cavities rather than to construct them as free standing, thereby reducing the amount of otherwise usable space preempted by the structure. Examples which are frequently encountered are towel dispensers, medicine cabinets, soap dispensers, and trash receptacles. The usual approach is to provide a cavity in the receiving wall which has the same dimensions as the structure to be inserted, and to position the structure into the cavity and secure it to a frame which is provided therein.

In the most common practice, the wall cavity is framed by a wooden, usually rectangular frame along the edges of the cavity, and the structure, usually essentially a sheet metal box, is inserted into the cavity and attached to the frame. In older construction the wall cavity itself may provide a suitable frame for attachment, if the wall is of sufficient thickness and has major non-plaster elements of construction.

It is, of course, difficult to assure that the cavity and frame provided are precisely the same size as the metal structure to be inserted. Commonly, the frame is slightly larger than the insert, with the result that it is difficult to attach the insert rigidly to the frame without distorting the contours of the insert. This distortion may be avoided by the use of the shim. However, as this requires considerable extra effort on the part of the installer, the shim is frequently ignored, and the insert simply attached, bent to "fit" and the resulting distortion tolerated.

The present invention overcomes this problem by providing a means for attaching the insert to a slightly larger frame cavity. When such means is provided, proper installation requires no extra effort on the part of the installer, and the distortion of the insert does not result.

SUMMARY OF THE INVENTION

In one aspect, the invention herein concerns a device for securing an insert, having a sheet metal periphery into a frame wall cavity. Ordinarily the insert will be rectangular and have at least three side plates interfacing at edges of 90°, so as to form the sides of a box. However, any shape insert may be used in applying the invention.

The device comprises one or more preferably planar tabs. Each tab is rigidly attached to the outside of the periphery and extends along the outside into the cavity to a point of attachment on the frame at some distance from its point of attachment to the insert. Preferably the tab is attached rigidly to the outside front edge of the periphery of the insert and extends back into the cavity along the outside of the insert to a point about three quarters of the way back on the frame. Each tab further contains a means for attaching the tab to the frame. The device also includes a means to access the tab from the inside of the insert. The tab is sufficiently rigid to support the insert, and sufficiently flexible to permit adjustable spacing between the attachment to the insert's periphery and the attachment to the frame.

In a second aspect, the invention concerns a method for installing a sheet metal insert using the device as set forth above.

BRIEF DESCRIPTION OF THE DRAWINGS

FIG. 1 shows the device of the invention attached to the front edge of the flanged insert.

FIG. 2 shows the device in use in attaching the insert to the frame.

DETAILED DESCRIPTION OF THE INVENTION

In general, fixtures which are to be inserted into building walls occupy or consist partly of, a housing which is constructed of sheet metal. The general shape of the housing is optional - e.g., it could be triangular, rectangular, circular, etc; but ordinarily it is that of a box, ordinarily a four-sided open box with a base to form the back of the fixture and with flanges at the top of the sides of the box to finish the adjacent surface on the wall. FIG. 1 represents a portion of a flange (1), side (2), and base (3) of the housing, as viewed from the outside of such an insert.

Depending on the fixture to be mounted, the insert may be modified according to the shape of the fixture and the amount of support needed sufficient surface areas conformed to the shape of the sides of the fixture is generally required. However, ordinarily the housing consists of a four-sided open box with an open top flanged sides, and a closed flat sheet base, which forms the back of the fixture as shown in FIG. 1.

Ideally, the insert could be mounted in the wall by simply inserting it into an exactly fitting cavity. As explained hereinabove, it is extremely difficult to construct a framed cavity with exactly the correct dimensions such that the housing when inserted will be supported simply by the frame or whereby a straightforward attachment (by, for example, mounting screws) of the inserted housing itself to the frame. If the dimensions are not exactly correct, this approach will result in a distorted mounting of the fixture.

In other words it is not fatal to the utility of the fixture mounting that the cavity is slightly larger than what is to be inserted. However, if, for example, the sides of the box were to be attached directly by screws to the wooden frame around the cavity, distortion of the box will result unless there is an exact fit.

The present invention provides a variable-space contact between the inserted housing and the frame's cavity. Briefly, the variable-space contact consists of a tab which is securely fastened preferably to the top of the box on the outside wall behind it's front flange (i.e., at that side of the box which will face out from the wall) and which is free to swing out from the side of the box toward the frame. At the end of the tab which contacts the frame, there is provided a means to attach that end of the tab securely to the frame. This is most easily accomplished by providing an appropriate opening such that the straightforward method of screwing the tab directly to the frame can be employed. However, clearly, other means could also be used; clips, nails, or other securing mechanisms, while not advantageous, are certainly workable.

In a preferred embodiment shown in FIG. 1, the tab (4) is a piece of flat stock similar to a leaf spring member which is riveted or welded to the front side of the housing at (5)—i.e., the top of the box--and which extends back approximately to the back edge of the frame. The tab is provided with a through hole (6) which may be utilized to mount the tab directly to the frame by means of a wood screw (7). In addition, it is necessary to provide a means to access the securing means from the inside of the box. This is most simply accomplished by providing an opening (8) on the box at the corresponding position.

FIG. 2 is a cross-sectional view of the installed insert which includes the inside of the box. The flange (1), side (2) and base (3) of the insert shown, positioned in the frame (11) formed by conventional wooden studs. The flange is flush to the front of the frame of the wall cavity at (12). One side (2) of the insert (i.e. the right side in FIG. 2) may be attached directly to the frame (11) in the conventional manner described above. On the other side (2) of the insert (i.e. the left side in FIG. 2) the tab (4) is positioned so as to bridge the space 13 between the insert and the frame, being attached to the outside of the insert at (5) the intersection of the side and flange, and, by means of a wood screw (7), to the frame (11). The opening which permits access to the frame attachment is shown at (8).

The dotted lines at (10) represent an additional tab at the side 90° with respect to that above described.

What is claimed is:

1. A device for in combination with a sheet metal insert for permanently securing said insert into a framed rough wall cavity of varying dimensions which device comprises:

one or more tabs, each tab being rigidly attached to a point on the outside of the periphery of the insert and extending to another portion within the cavity along the outside of the insert, each tab further containing a means for attaching the extending end tab to the framed wall cavity said tabs being sufficiently rigid to support the insert and sufficiently flexible to permit adjustable spacing between the attachment to the insert and the attachment to the frame; and a means to access the tab from the inside of the insert.

2. The device of claim 1 wherein each tab is planar.

3. The device of claim 2 wherein each tab is constructed of heavy gauge flat stock metal.

4. The device of claim 3 wherein the means for attaching each tab to the frame comprises a circular hole so as to permit the tab to be attached to the frame by means of a screw.

5. The device of claim 4 wherein the means to access the tab from the inside of the insert is an opening in the periphery of the insert next to the circular hole in the tab.

6. The device of claim 1 wherein each tab is attached rigidly to the outside front edge of the periphery of the insert, and extends back into the cavity.

7. The device of claim 1 wherein the insert has a rectangular periphery.

8. In a permanent mounting device in combination with an insert to be mounted in a rough framed cavity having at least two opposite sides spaced by varying amounts to which the insert is to be attached and supported, said combination comprising, at least one elongated tab means having one end rigidly attached on the exterior of one side of the insert and extending between and at an acute angle to the insert and the adjacent side of the framed cavity, means for attaching the said extending end of said tab means to that side of the framed cavity, said tab means being of sufficient length to accommodate the varying spaces between the opposite sides of the framed cavity by being bendable toward and away from the insert side, and said insert having means facilitating attachment of said tab to said frame cavity.

9. The mounting device of claim 8 wherein said tab means is attached at the front of the insert and extends rearwardly.

10. The mounting device of claim 8 wherein said attachment facilitating means comprises an opening on the side of said insert adjacent the said extending end of said tab means.

11. A permanent mounting device in combination with an insert having a side thereof to be mounted in a rough framed cavity of varying dimensions, said combination comprising, an elongated tab having one end securely attached to an outer surface of said side of the insert and extending away from said surface at an acute angle thereto for a substantial length, said tab being bendable toward and away from that side of the insert, an opening in that side of the insert adjacent the extending end of said tab for access to said tab for attaching said tab to the framed cavity from inside the insert, and said tab that having means for attachment thereof to said framed cavity.

* * * * *